United States Patent [19]

Fasano

[11] Patent Number: 4,760,226

[45] Date of Patent: Jul. 26, 1988

[54] SPLIT CASE CIRCUIT BREAKER WITH MULTI-PURPOSE WELL

[75] Inventor: Michael A. Fasano, Watertown, Conn.

[73] Assignee: Carlingswitch, Inc., West Hartford, Conn.

[21] Appl. No.: 36,107

[22] Filed: Apr. 8, 1987

[51] Int. Cl.[4] ..... H01H 73/12; H01H 9/02

[52] U.S. Cl. ..... 200/303; 335/13; 200/153 T

[58] Field of Search ..... 200/293, 303, 307, 153 G, 200/153 SC, 308, 153 T, 47, 280, 281; 335/132, 202, 13

[56] References Cited

U.S. PATENT DOCUMENTS

| | | | |
|---|---|---|---|
| 3,284,731 | 11/1966 | Nicol | 335/13 |
| 3,388,357 | 6/1968 | Lawson et al. | 335/13 |
| 3,593,235 | 7/1971 | Nicol | 335/13 X |
| 3,602,852 | 8/1971 | Brackett, Sr. et al. | 200/303 |
| 3,720,891 | 3/1973 | Nicol | 335/13 |
| 3,742,402 | 6/1973 | Nicol et al. | 335/13 |
| 3,742,403 | 6/1973 | Nicol | 335/13 |
| 4,087,772 | 5/1978 | Grenier | 335/202 |
| 4,151,386 | 4/1979 | Nicol et al. | 200/303 |

OTHER PUBLICATIONS

Brochure, "Magnetic Circuit Breakers, Series A & B", Carlingswitch, Recvd. 11-4-87.

*Primary Examiner*—Henry J. Recla
*Assistant Examiner*—Ernest G. Cusick
*Attorney, Agent, or Firm*—McCormick, Paulding & Huber

[57] ABSTRACT

A split case breaker housing has a depending well at the bottom and any one of three different filler blocks can be assembled with the split case sections to provide a convenient receptacle for a limit switch or for auxiliary studs, or to simply close the opening provided in the well for these filler blocks.

3 Claims, 5 Drawing Sheets

SPLIT CASE CIRCUIT BREAKER WITH MULTI-PURPOSE WELL

BACKGROUND OF THE INVENTION

This invention relates generally to magnetic circuit breakers of the type having a split case configuration, and deals more particularly with such a circuit breaker case configuration having a shallow well defined in the breaker case for receiving either an auxiliary switch, or a filler block of the type adapted to support two auxiliary terminals generally between the main terminals normally provided in such a case.

The general object of the present invention is provide a split case circuit breaker configuration that has a well for receiving either a first filler block with a conventional auxiliary switch, or a second filler block with auxiliary terminals, or a simple closure in the event that such auxiliary switch or auxiliary terminals are not required.

In its presently preferred form the invention resides in a generally rectangular circuit breaker case having first and second mating case sections each of which have a top and bottom edge. These case sections may be stacked together to provide a circuit breaker assembly capable of handling several interrelated electrical circuits connected to the breakers through main terminals provided in the bottom edge of these mating case sections. Each pair of first and second case sections fit together to form internal cavities for a conventional circuit breaker mechanism. The bottom peripheral edge portions cooperate to define a generally rectangular well having an opening along this bottom edge. The opening may be fitted with one of several differently configured filler blocks. The switch case opening is defined by edges that include grooves to receive marginal edge portions of both types of filler blocks, and in one type of filler block the opposed end portions are open to receive auxiliary terminals or studs that are also supported in part by the mating edge portions of the circuit breaker housing case sections. Another of the filler blocks includes an upwardly open cavity for receiving a conventional limit switch and retaining it in the filler block prior to assembly with the case sections. Alternatively, two auxiliary stud terminals can be provided in a filler block of alternative construction so that this subassembly can be provided in the same generally rectangular opening provided for this purpose in the well defined between the mating case sections. Finally, a planar block or closure can be provided to fill the opening when the above described filler blocks are not required.

DESCRIPTION OF THE PREFERRED EMBODIMENT

Figure 1:
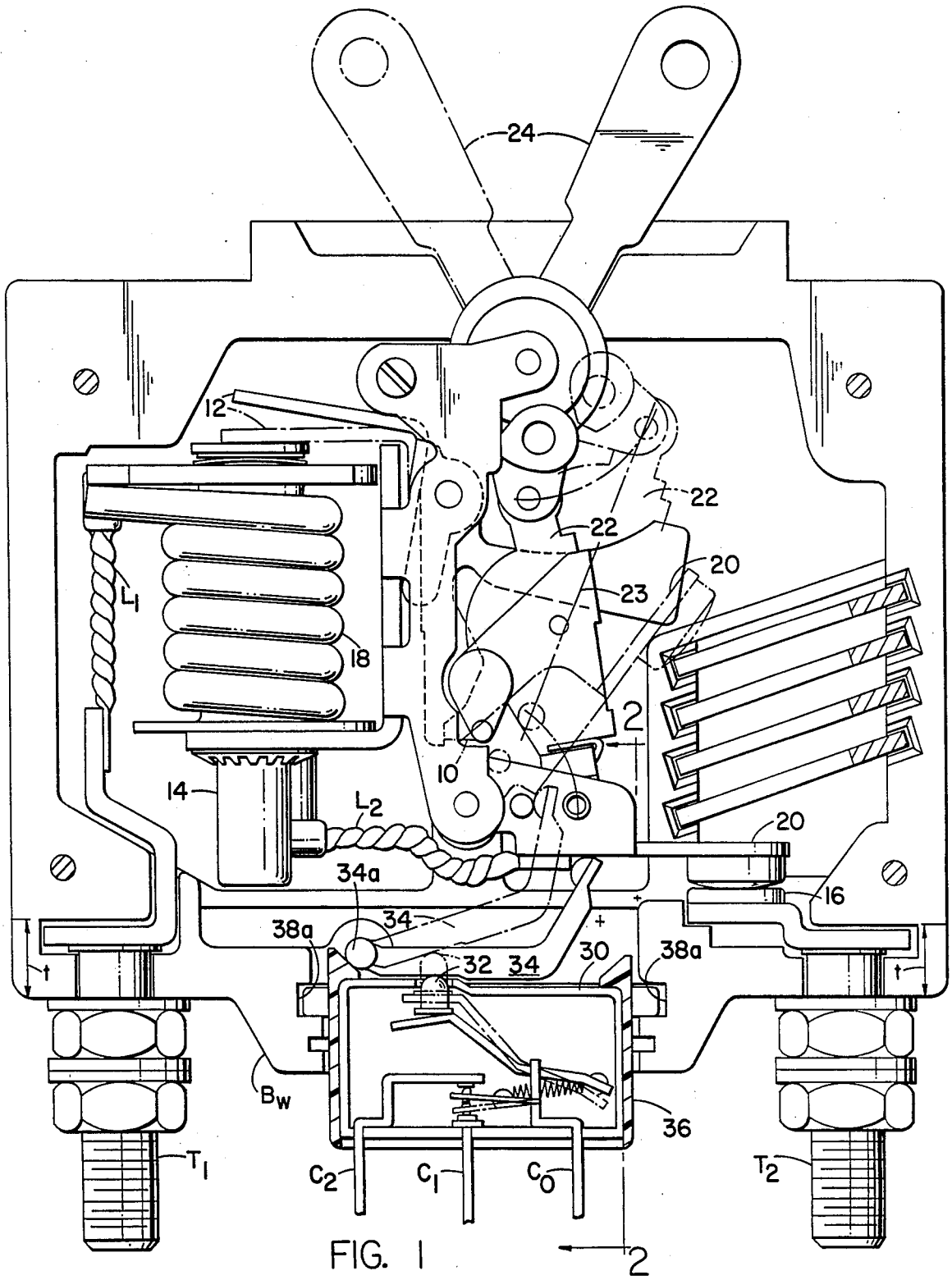
FIG. 1 is a side elevational view of a circuit breaker case incorporating features of the present invention, the lower portion of the breaker being illustrated in vertical section with portions being broken away to reveal a subassembly of a filler block and auxiliary switch provided in a lower well of the case. The circuit breaker mechanism is shown schematically for reference purposes.

Turning now to the drawings in greater detail, FIG. 1 shows a magnetic circuit breaker of conventional internal configuration being generally similar to that described in issued U.S. Pat. No. 4,347,488 entitled "MULTI-POLE CIRCUIT BREAKER" issued Aug. 31, 1982 and assigned to the assignee herein. Such a circuit breaker generally includes a collapsible link provided between a movable contact arm 20 and a pivotably mounted toggle actuator 24. The collapsible link structure is indicated schematically at 22 and as suggested by the broken line 23 is adapted to be operated without collapsing by the actuator link 24 so as to achieve direct opening and closing movement of the movable contact arm 20. The circuit breaker is connected in a circuit to be protected through terminals $T_1$ and $T_2$ and FIG. 1 illustrates terminal $T_1$ as connected by lead $L_1$ to an internal electromagnetic coil 18 and from the coil to the movable contact arm by lead $L_2$. When the movable contact arm 20 is in the solid line position, to achieve closing of its contact with fixed contact 16, electrical current will flow through the coil 18 unless current flow is interrupted by toggle actuator 24. When the current in the coil 18 exceeds a predetermined design level a magnetic circuit will be closed through a core (not shown) in element 14 drawing armature 12 downwardly causing pin means 10, or link 23 to be acted upob by a leg of the armature. A collapsible link is defined by link 23 and link 22. This electromagnetic tripping process causes the link 22/23 to collapse and the circuit breaker contacts to open. Movable contact lever 20 can also be moved from the closed position to the open position shown in phantom lines as a result of manually opening the breaker by toggle 24.

In accordance with conventional circuit breaker design a limit switch may be provided to sense the position of the contact arm 20 and to provide signal indicative of breaker condition at a remote location. In accordance with the present invention such a limit switch is indicated generally at 30 and includes a plunger 32 normally projecting upwardly through a top opening in the limit switch housing 30 where it is engaged by a pivotably mounted lever 34. The upwardly biased plunger 32 urges the lever 34 from the solid line position toward the phantom line position shown in FIG. 1 in order to provide an indication of the position for the contact lever 20. That is, when the lever 20 is in the solid line or closed contact position shown in FIG. 1 contact lever 34 is held downwardly and the condition of the limit switch 30 is such that switch contact $C_O$ and $C_2$ are closed and $C_2$ and $C_1$ are open. When the movable circuit breaker contact arm 20 is open as shown in phantom lines in FIG. 1 plunger 32 of limit switch 30 is allowed to move upwardly and as a result contact $C_O$ and $C_1$ of limit switch 30 are closed $C_O$ and $C_2$ being opened as well. Thus, depending upon which switch contacts are closed limit switch 30 provides convenient electrical signals for the condition for the movable contact 20 of the circuit breaker.

Figure 2:
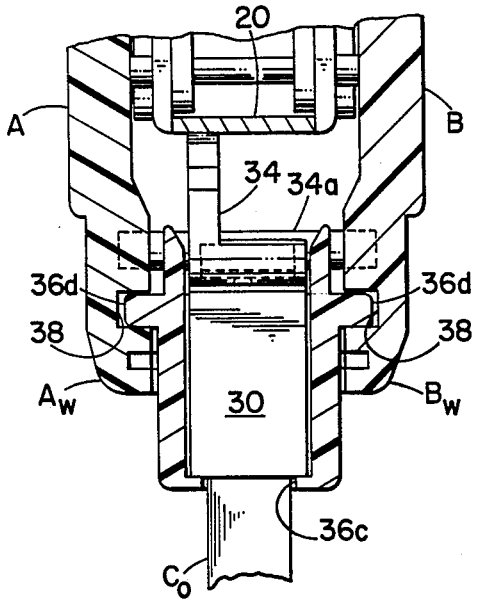
FIG. 2 is a vertical sectional view taken generally on the line 2—2 of FIG. 1.
Figure 3:
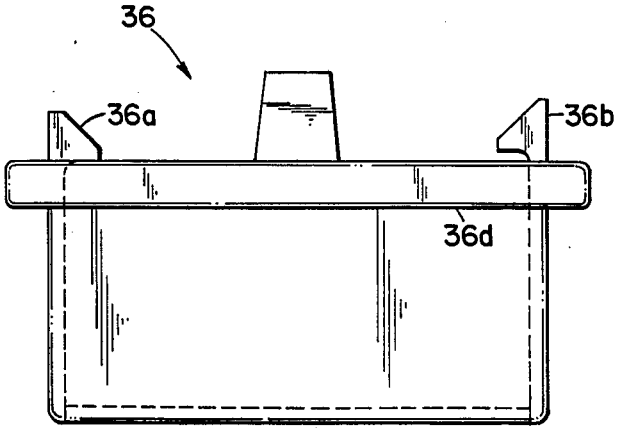
FIG. 3 is an elevational view of the filler block provided in the well of the circuit breaker in FIGS. 1 and 2.
Figure 4:
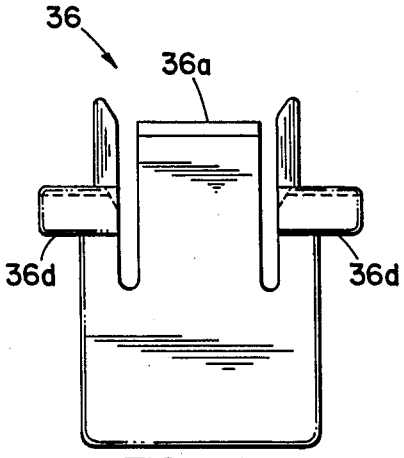
FIG. 4 is an end view of the filler block of FIG. 3.
Figure 5:
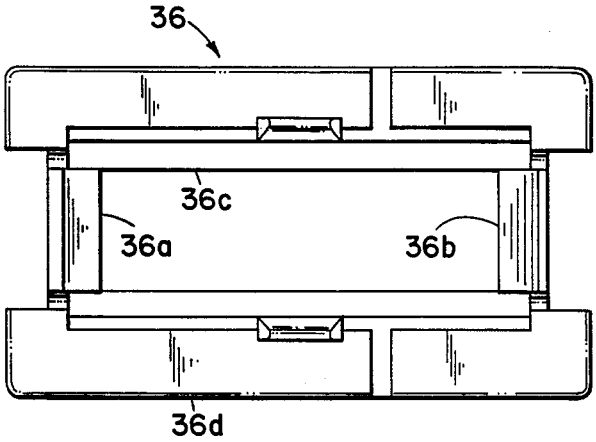
FIG. 5 is top plan view of the filler block of FIG. 3.
Figure 6:
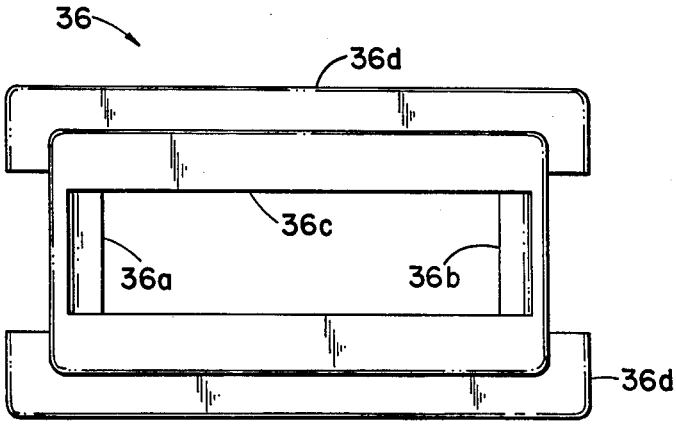
FIG. 6 is a bottom plan view of the filler block of FIG. 3.

In accordance with the present invention a conventional limit switch 30 is held in a uniquely constructed filler block 36 shown in detail in FIGS. 3, 4, 5 and 6. FIGS. 3 and 4 show the filler block 36 as including opposed end wings 36*a* and 36*b* which are adapted to be resiliently deflected outwardly as the rectangularly shaped limit switch 30 is inserted downwardly into the filler block 36. The bottom wall of the filler block 36 is open as shown by the opening 36*c* in FIGS. 5 and 6 but the opening 36*c* is somewhat smaller than the rectangular configuration for the limit switch case 30 and the limit switch 30 is held in the position shown for it in FIG. 1 by the difference in width of the opening 36*c* (see FIG. 2).

Still with reference to the filler block 36 for the limit switch 30, longitudinally extending flanges 36*d* are provided along both longitudinally extending upper edges of the filler block 36 to provide a convenient means for mounting the filler block 36 in place in the circuit breaker housing. More particularly, and with reference to FIGS. 1 and 2 the split case circuit breaker includes separable half sections A and B which are generally rectangular in shape and have top and bottom edges with complementry peripheral portions fitting together to define an internal cavity for the various circuit breaker components. These half sections A and B fit together for this purpose and well defining portions $A_w$ and $B_w$ are provided along the bottom edge of the circuit breaker case or housing to receive the filler block 36. More particularly, each of these well defining portions includes an elongated grooves 38. The groove 38 is adapted to receive one of the flanges 36*d* of the filler block 36. These flanges 36*d* extend beyond the wing defining portions 36*a* of the filler block 36 as best shown in FIG. 1 to be received in end portions 38*a* of the groove 38 in the housing half sections A and B.

The switch lever 34, best shown in FIGS. 1 and 2, has a generally L-shape, an upstanding leg of the L having its free end portion adapted to contact the underside of the moveable contact lever 20 and another or opposite end of the leg defining a cross pin 34*a*. This pin 34*a* has axle defining end portions adapted to be received in aligned openings provided for this purpose in the opposed circuit breaker housing sections A and B.

In summary the limit switch 30 is of conventional construction and is adapted to be mounted or assembled in the unique filler block 36 by insertion downwardly past the resilient wings to be held therein. This combination provides a convenient subassembly readily assembled with the circuit breaker housing half sections A and B. The lever 34 is also conveniently assembled with these half sections to provide the circuit breaker configuration illustrated in FIGS. 1 and 2.

Figure 7:
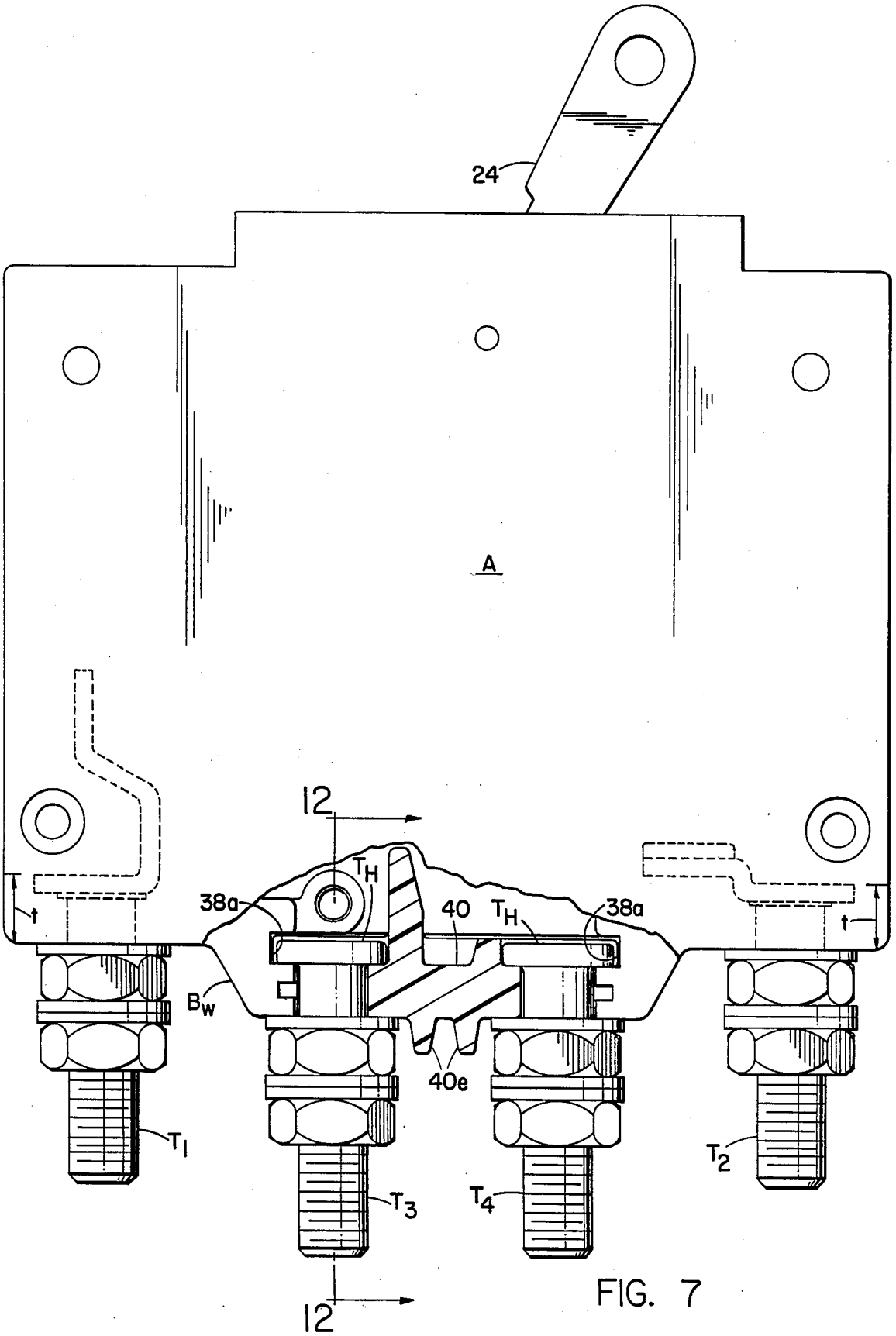
FIG. 7 is a view of the circuit breaker illustrated in FIG. 7 but with the filler block and auxiliary switch removed and replaced by a filler block of alternative construction supporting two auxiliary stud terminals.

The circuit breaker of FIG. 7 is generally similar to that of FIG. 1, and includes the same internal mechanism for operating the circuit breaker contacts through main terminal studs $T_1$ and $T_2$ However, the filler block 36 has been removed as has the lever 34 and limit switch 30 to be replaced by a filler block 40 and auxiliary terminals $T_3$ and $T_4$. These auxiliary terminals $T_3$ and $T_4$ are generally similar to those described previously with reference to $T_1$ and $T_2$ but are mounted in the well portion defined by the circuit breaker case half sections $A_w$ and $B_w$.

Figure 8:
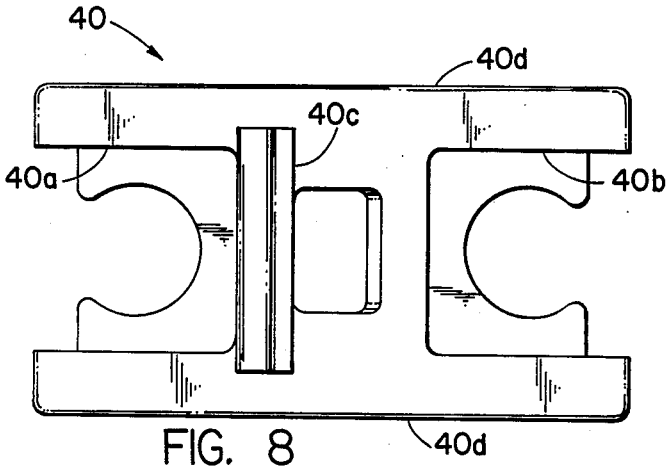
FIG. 8 is a top plan view of the filler block illustrated in FIG. 7.
Figure 9:
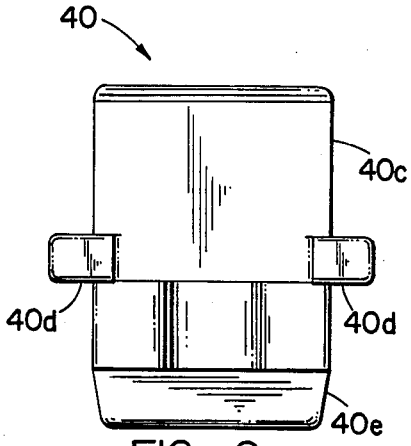
FIG. 9 is a side elevational view of the FIG. 8 filler block.
Figure 10:
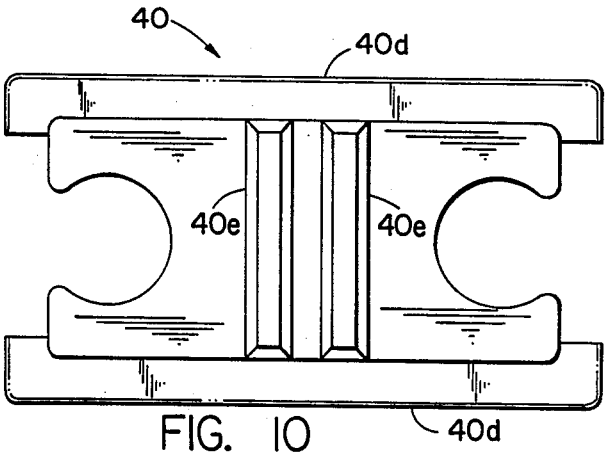
FIG. 10 is a bottom plan view of the filler block illustrated in FIG. 8.
Figure 11:
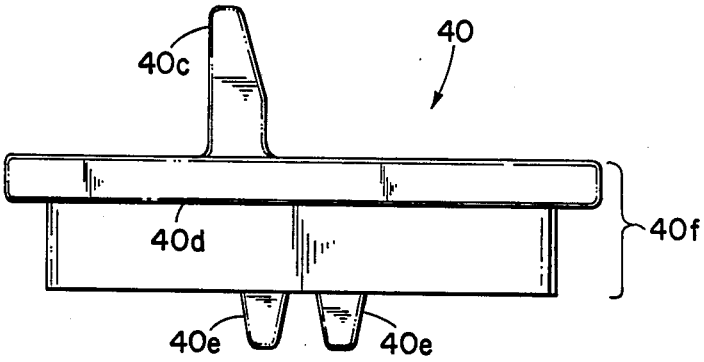
FIG. 11 is a side elevational view thereof.
Figure 12:
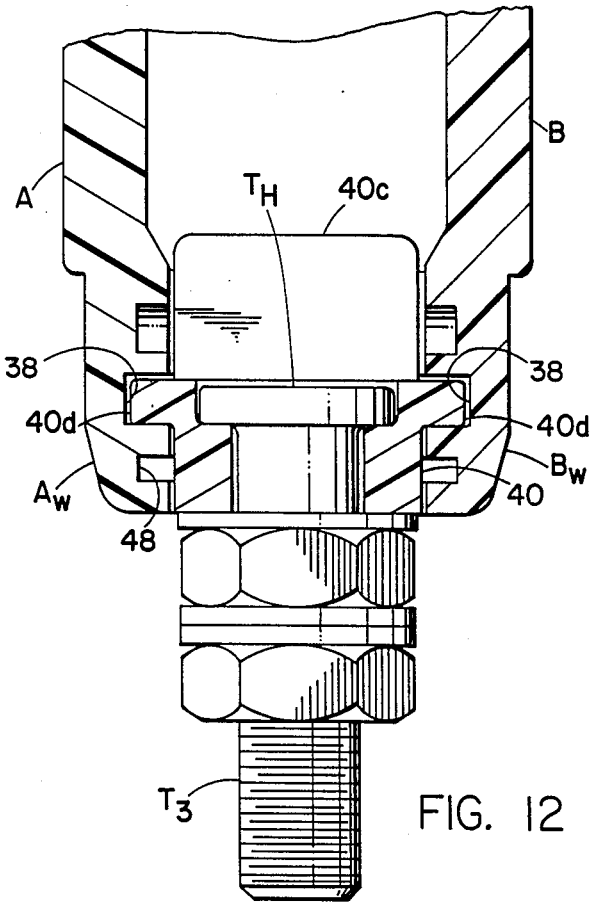
FIG. 12 is a vertical sectional view taken generally on the line 12—12 of FIG. 7.

FIGS. 8–11 illustrate the configuration for this filler block 40, and more particularly show the marginal edges or flanges 40*d* that fit within the grooves 38, 38 provided for this purpose in the well defining portions $A_w$ and $B_w$ of the circuit breaker housing half sections A and B. FIG. 12 shows this geometry and FIG. 7 illustrates the end portions 38*a* of these grooves 38 as receiving annular head portions $T_H$ of the auxiliary studs $T_3$ and $T_4$. These head portions $T_H$ are also received in recesses 40*a* and 40*b* of the filler block 40 as best shown in FIG. 8. As so constructed and arranged the auxiliary terminals $T_3$ and $T_4$ are separated one from another by approximately the same distance as that between each of these auxiliary terminals $T_3$ and $T_4$ and an adjacent main terminal $T_1$ and $T_2$ respectively. The head portions $T_H$ of these auxiliary studs are further isolated from one another electrically by a vertically extending stub wall 40*c*. Somewhat shallower walls are provided on the underside of the filler block 40 as illustrated at 40*e*. The depth of the body portion of filler block 40 shown at 40*f* in FIG. 11 is substantially the same as the thickness (t) of the bottom wall defined by the half sections A and B. Thus, the rather shallow well defined by the circuit breaker case sections allows the auxiliary studs $T_3$ and $T_4$ to be of the same geometry as the main studs $T_1$ and $T_2$ and yet to extend below these main studs by a distance or displacement on the order of the thickness (t) provided for the bottom of the circuit breaker housing itself. This thickness (t) has significance in regard to the requirements for insulating the various terminals in a heavy duty circuit breaker such as that shown here, and such thickness has been designated by the lower case t in FIGS. 1, 7 and 13.

Figure 13:
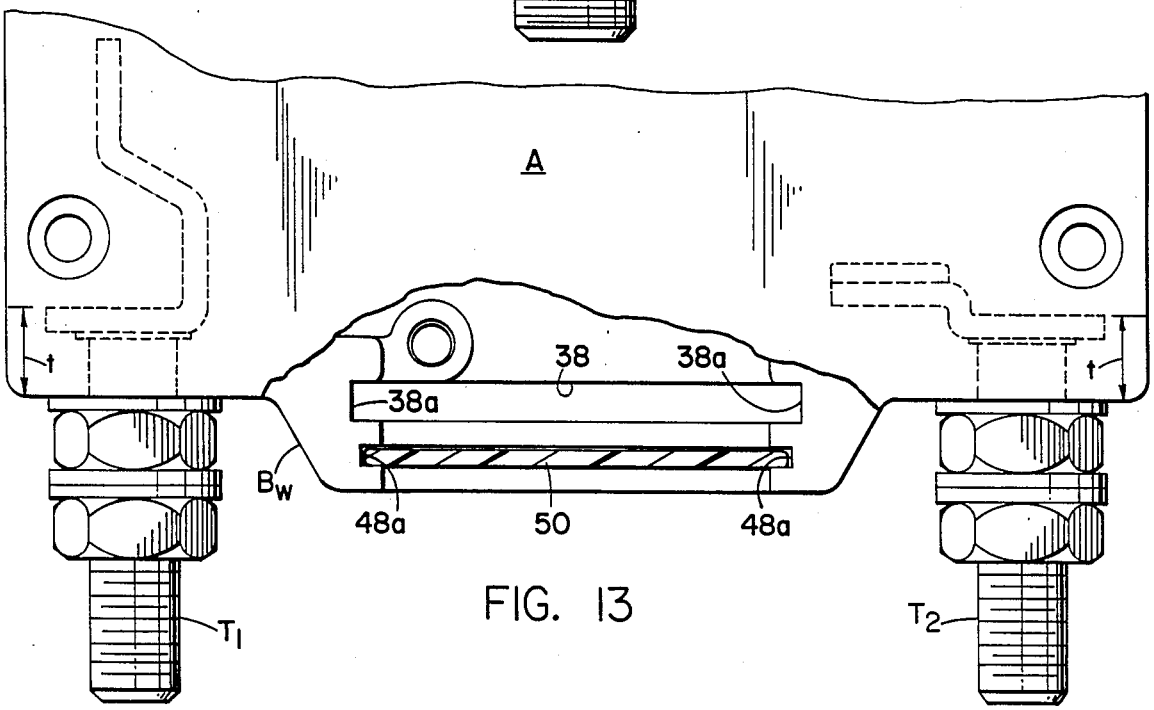
FIG. 13 is a partial view of the same basic circuit breaker as illustrated in FIGS. 1–12, but with the filler blocks replaced by a planar block to close the downwardly open well in the bottom edge of the breaker housing.

With particular reference to FIG. 13, the circuit breaker housing sections A and B are shown in assembled relationship with only a main pair of terminal studs $T_1$ and $T_3$. The filler blocks 36 and 40 described above have also been removed in favor of a single flat plate insulating block 50 which is provided in groove 48 spaced somewhat below the groove 38 used to support the above described filler blocks 36 and 40. The grooves 48 have end portions 48*a* for receiving the ends of block 50 to further insulate and isolate the internal components of the circuit breaker from the exterior environment where the circuit breaker housing is ultimately mounted.

I claim:

1. A split case circuit breaker housing comprising first and second case half sections, said half sections cooperating to define an internal generally rectangular circuit breaker cavity, a circuit breaker mechanism provided in said cavity, said half sections havaing peripheral edge portions mating with one another and including bottom edges that cooperate to define a generally rectangular well communicating with said internal circuit breaker cavity, a first filler block having laterally opposed flanges, said first first filler block also including longitudinally opposed resilient wings, said bottom edges of said peripheral half section edge portions defining a groove for receiving said laterally opposed flanges, said first filler block defining a downwardly open limit switch housing, a limit switch retained in said filler block housing by said longitudinally opposed resilient wings, said limit switch having a plunger actuator projecting upwardly into said circuit breaker cavity, means for operating said plunger in response to movement of said circuit breaker mechanism, and a second filler block also adapted to be received in said circuit breaker half section well, said second filler block having laterally opposed flanges, and said half section peripheral bottom edges defining a slot for receiving said second filler block flanges, and terminals provided in openings defined in part by said peripheral bottom edges of said circuit breaker half sections and in part by said second filler block.

2. The circuit breaker housing according to claim 1 wherein said means for operating said plunger in response to movement of said circuit breaker mechanism comprises a pivoted actuating lever provided internally of the circuit breaker housing cavity and including opposed axle defining portions, said circuit breaker half section bottom edges defining aligned openings for said axle defining portions, said actuator lever having a free end portion opposite said axle defining portions for engagement with said circuit breaker mechanism.

3. The circuit breaker housing according to claim 1 further characterized by a generally planar rectangular third filler block having laterally opposed sides, said bottom edges defining a second filler block slot for receiving said opposed sides of said third filler block in said rectangular opening of said circuit breaker housing half sections, either of said first, second and third filler blocks being so assembled with the circuit breaker half sections.

* * * * *